US005783902A

United States Patent [19]

McCann

[11] Patent Number: 5,783,902

[45] Date of Patent: Jul. 21, 1998

[54] CONVERGENCE COIL ASSEMBLY

[75] Inventor: Timothy T. McCann, Mt. Prospect, Ill.

[73] Assignee: Zenith Electronics Corporation, Glenview, Ill.

[21] Appl. No.: 653,741

[22] Filed: May 23, 1996

[51] Int. Cl.[6] ..... H01J 29/70

[52] U.S. Cl. ..... 313/440; 335/210; 335/213; 445/3; 445/23

[58] Field of Search ..... 313/440; 332/210, 332/213; 445/3, 23

[56] References Cited

U.S. PATENT DOCUMENTS

| | | | |
|---|---|---|---|
| 3,573,525 | 4/1971 | Fuse et al. | 335/210 |
| 5,119,056 | 6/1992 | Itoh et al. | 335/210 |
| 5,565,732 | 10/1996 | Sluyterman et al. | 313/440 |

*Primary Examiner*—Nimeshkumar Patel

[57] ABSTRACT

The improved convergence core assembly utilizes a separate carriage for the convergence core. This separate carriage properly aligns and holds the convergence core in relation to the convergence core assembly. In particular embodiments, the separate core carriage provides self centering and positional stability for the convergence core in the x-y plane, in the z-axis, and rotationally in the x-y plane. To accomplish this, the core carriage includes means for positioning the convergence core in the convergence core assembly. In certain embodiments, the means for positioning includes leaf springs and positioning tabs. The leaf springs tend to force the electromagnetic coil assembly against the stops of the positioning tabs to properly locate the convergence core in the z-axis. The positioning tabs also exert opposing spring forces on the convergence core to center the convergence core assembly in the x-y plane. Furthermore, at least one of the positioning tabs has an indexing protrusion to engage a positioning groove on the core of the convergence core assembly for rotational alignment of the convergence core.

19 Claims, 16 Drawing Sheets

CONVERGENCE COIL ASSEMBLY

FIELD OF THE INVENTION

The present invention relates generally to cathode ray tubes (CRTs) and specifically to a convergence core, which is an additional electromagnetic field producing unit added to the deflection yoke of a CRT in order to focus or "converge" the electrons in the beam bundle in order to make an optimal beam spot on the screen.

BACKGROUND OF THE INVENTION

CRTs are used in television sets, monitors and displays. With reference to FIG. 1*a*, a monochrome (one beam) CRT 2 forms an image by scanning an electron beam 3 across a phosphor screen 4. The electron beam 3 is emitted from an electron gun 1 located at a first cathode end 6 of the CRT 2 in the neck 8 of the CRT 2. The beam 3, sometimes called a "beam bundle", is then scanned across the screen 4 by a deflection yoke assembly 10.

FIG. 1*b* shows a cathode end view (facing the electron gun) of a known deflection yoke assembly 10 (without a terminal cap), such as a Sanyo deflection yoke model no. 95-4414-01, using a convergence core 12 having a ferrite core 14 wrapped with electromagnetic coils 16. The convergence core 12 should center the electron beam in the yoke 10 and compress the beam bundle, therefore the convergence core has to be well, and consistently, centered in the yoke assembly for it to work properly. In current designs, opposing pairs of position tabs 18 on the yoke liner 20 hold the convergence core 12 in place with opposing compressive forces without the self centering of the convergence core 12 in the yoke liner 20. Further, centering in the x-y plane and the z-axis depends on how accurately the yoke liner halves 20*a* and 20*b* align. Additionally, the position tabs 18 do not fully prevent the convergence core from misalignment along the z-axis. Current convergence cores 12 also provide an index groove 22 on the core 14 for very simple rotational alignment with the position tab 18 which is subject to error.

Another problem with current convergence cores is that they require labor intensive assembly onto the back of the yoke liner 20. As such, the yoke liner 20 requires special lead tie offs and wire guide features 24, and the leads for the coil 16 have to be hooked up to the exterior yoke terminal 26 while on the assembly line. Consequently, current designs require a separate cover 28 (FIG. 1*c*) for its terminal lugs 26 (FIG. 1*b*). Additionally, as shown in FIG. 1*c*, the terminal cap 28 in Sanyo design contains the fingers 30 which indirectly clamp 32 the whole yoke assembly 10 to the neck of the CRT 2.

OBJECTS OF THE INVENTION

It is an object of the present invention to provide an improved convergence core assembly which properly aligns and retains the convergence core within the yoke liner.

It is also an object of the present invention to provide a convergence core assembly with greater positional stability for the convergence core.

It is another object of the present invention to provide a convergence core assembly which is easy to assemble and install and reduces assembly time and costs associated with the convergence core assembly itself and the yoke assembly.

It is still another object of certain embodiments of the present invention to provide a convergence core assembly which does not require a separate housing for the convergence core.

To accomplish these and other objects, the improved convergence core assembly utilizes a separate carriage for the convergence core. This separate carriage properly aligns and holds the convergence core in relation to the convergence core assembly. In particular embodiments, the separate core carriage provides self centering and positional stability for the convergence core in the x-y plane, in the z-axis, and rotationally in the x-y plane. To accomplish this, the core carriage includes means for positioning the convergence core in the convergence core assembly. In certain embodiments, the means for positioning includes leaf springs and positioning tabs. The leaf springs tend to force the electromagnetic coil assembly against the stops of the positioning tabs to properly locate the convergence core in the z-axis. The positioning tabs also exert opposing spring forces on the convergence core to center the convergence core assembly in the x-y plane. Furthermore, at least one of the positioning tabs has an indexing protrusion to engage a positioning groove on the core of the convergence core assembly for rotational alignment of the convergence core.

In accordance with other aspects of certain embodiments of the present invention, the core carriage further includes means for consistently positioning the convergence core carriage in relation to the deflection yoke assembly. For example, a convergence core assembly has retaining arms which hold the convergence core assembly in relation to the deflection yoke assembly, and centering arms engage an inside wall of the yoke liner of the deflection yoke assembly to provide centering/positional stability for the convergence core assembly within the yoke liner.

In certain embodiments, the core carriage has its own terminal lugs, and this allows the convergence core assembly to be built as a separate assembly, which includes the carriage and the convergence core, with all its own leads in place. As such, the convergence core assembly is merely inserted into a yoke liner as a complete unit. Certain embodiments of the convergence coil assembly do not need a separate cover for its terminal lugs because the yoke liner surrounds the convergence core assembly. Also, the yoke liner used with certain embodiments of the improved convergence coil assembly has fingers built in, thus eliminating potential imprecision in mounting the yoke to the neck of the CRT.

BRIEF DESCRIPTION OR THE DRAWINGS

Other aspects and advantages of the present invention may become apparent upon reading the following detailed description and upon reference to the drawings in which:

FIG. 1*a* shows a prior art CRT configuration, and FIG. 1*b* shows a cathode end view (facing the electron gun) of a prior art convergence core/deflection yoke assembly (without terminal cover); and FIG. 1*c* shows a side view of a prior art convergence core/deflection yoke assembly with terminal cover;

FIG. 2 shows a CRT equipped with a deflection yoke assembly using the convergence core assembly and yoke liner according to the principles of the present invention;

FIG. 3*a* shows a partially exploded side view of an in-process deflection yoke assembly with the convergence core assembly and yoke liner according to the principles of the present invention; FIG. 3*b* shows a front or screen side view of the in-process deflection yoke assembly of FIG. 3*a*; FIG. 3*c* shows a cross-section view along line c—c of FIG. 3*a*; FIG. 3*d* shows a bottom view of FIG. 3*c*; and FIG. 3*e* shows opposing perspective views of yoke liner halves according to the principals of the present invention.

FIG. 4*a* shows a top view of a core carriage according to the principles of the present invention; FIG. 4*b* shows a cross-section view along line b—b of FIG. 4*a* with a convergence core in position for insertion into the core carriage; FIG. 4*c* shows a perspective view of the convergence core assembly; FIG. 4*d* shows a cathode end view of the convergence core assembly positioned within the yoke liner; and FIG. 4*e* shows an inprocess deflection yoke assembly from the other end with horizontal deflection coils in place; and FIGS. 5*a* and 5*b* show how the deflection yoke assembly connects to the neck of the CRT according to the principles of the present invention.

DETAILED DESCRIPTION OF THE PREFERRED EMBODIMENT

An illustrative embodiment of an improved convergence core assembly and yoke liner of the present invention is described below as it might be implemented to provide improved positioning and positional stability of the convergence core and more efficient manufacturing of a deflection yoke assembly.

Figure 1A:
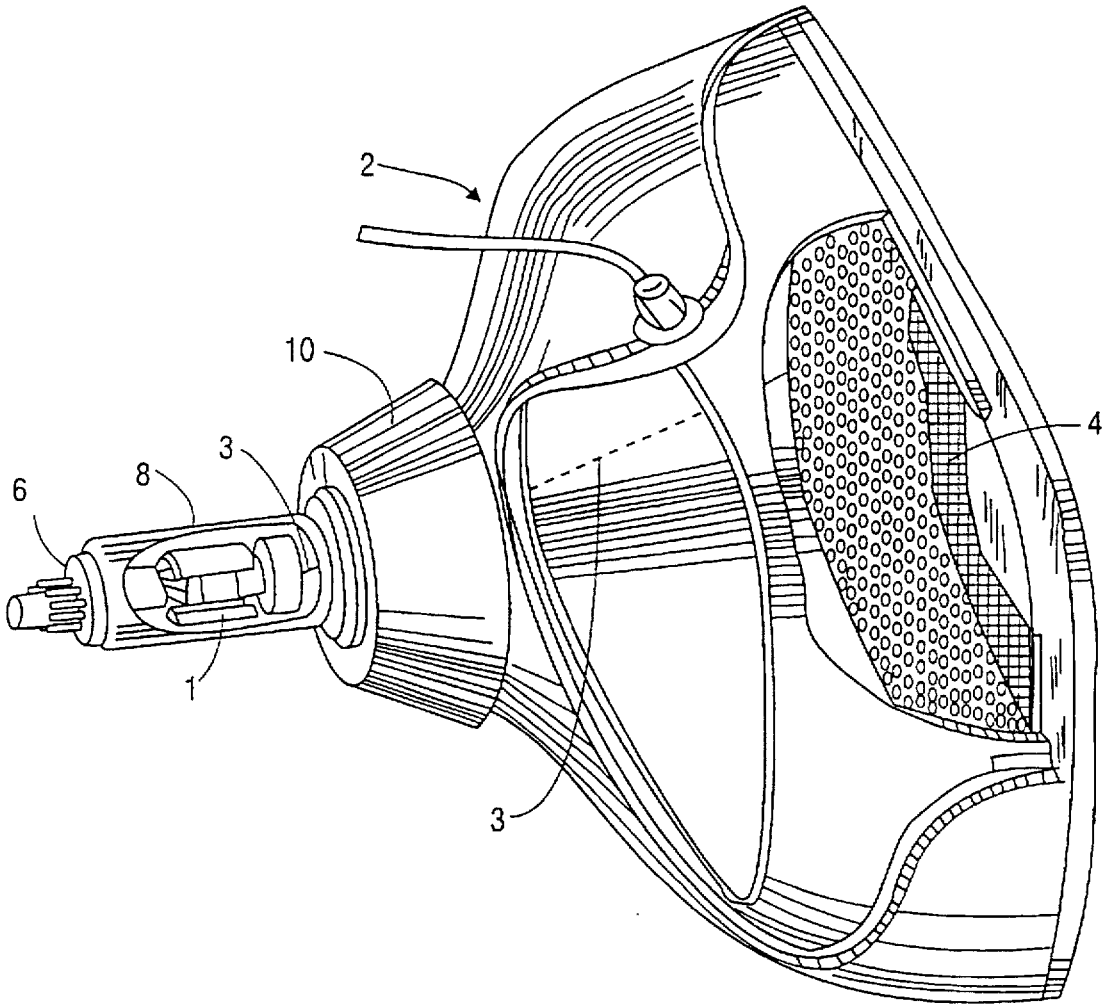
FIG.1A (PRIOR ART)
Figure 1B:
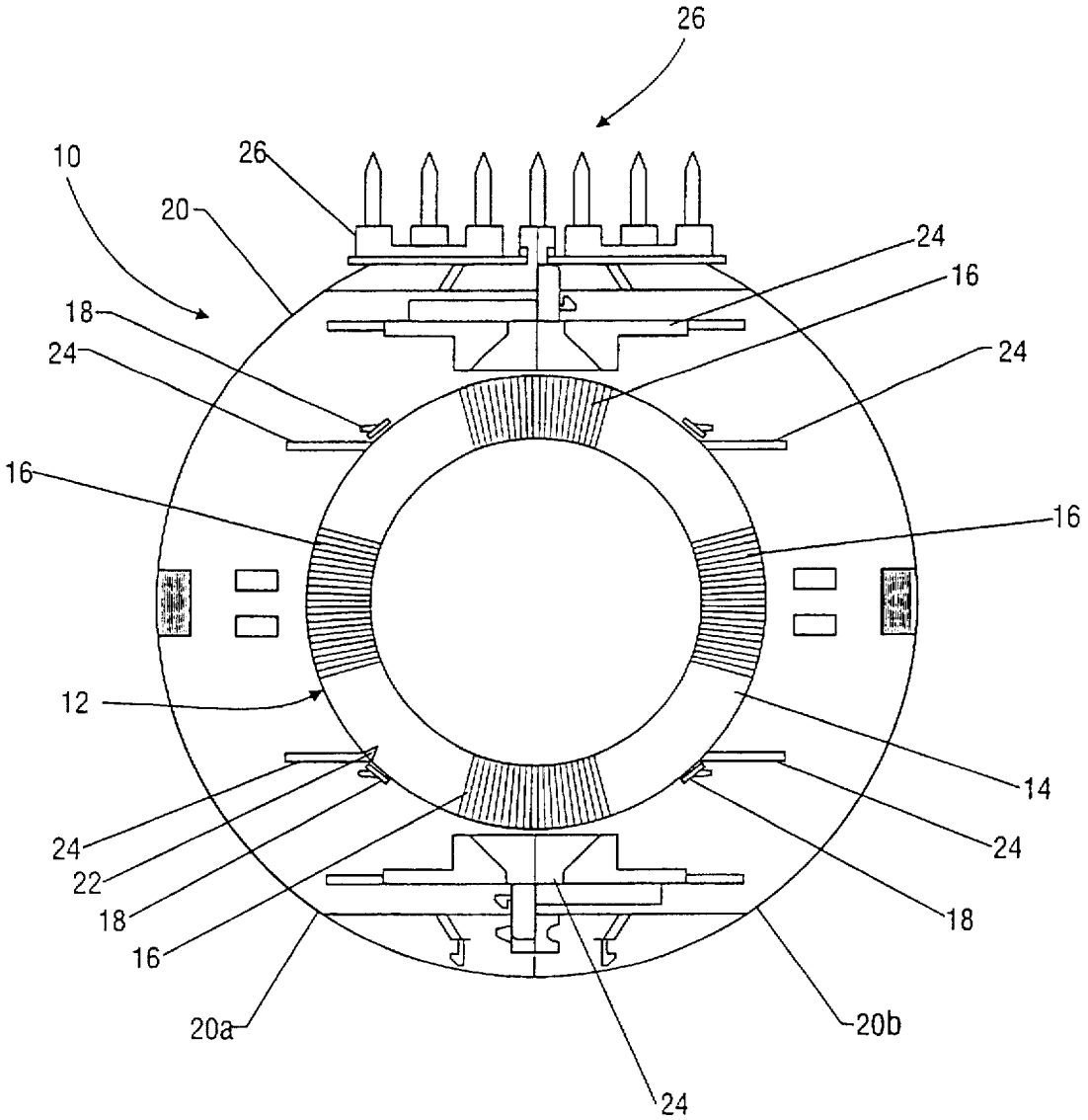
FIG. 1B (PRIOR ART)
Figure 1C:
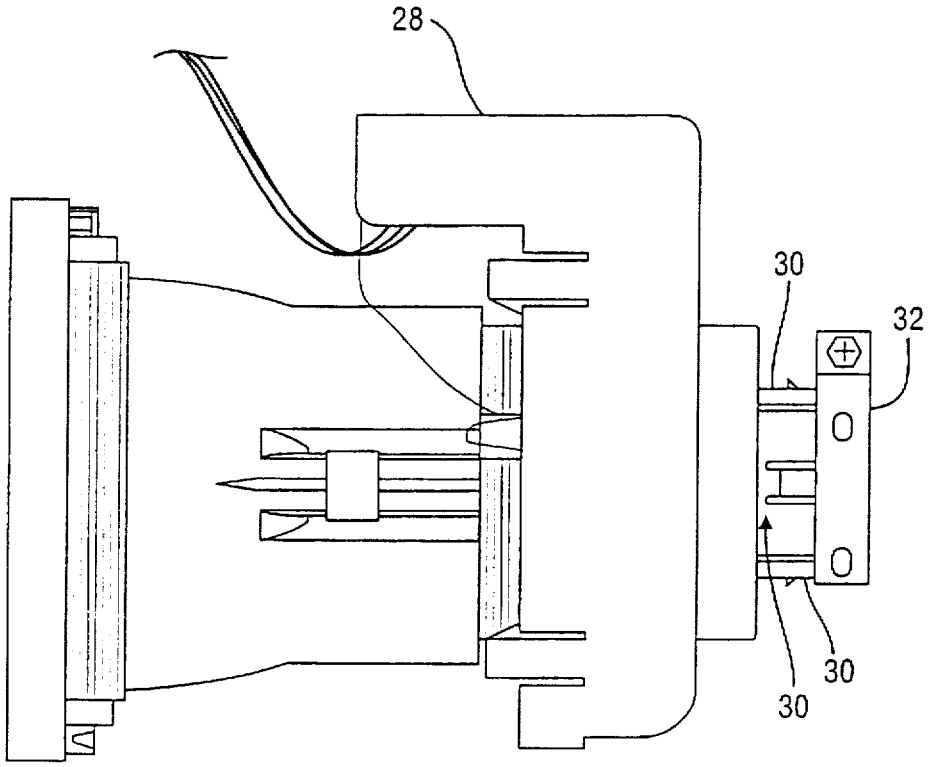
FIG. 1C (PRIOR ART)
Figure 2:
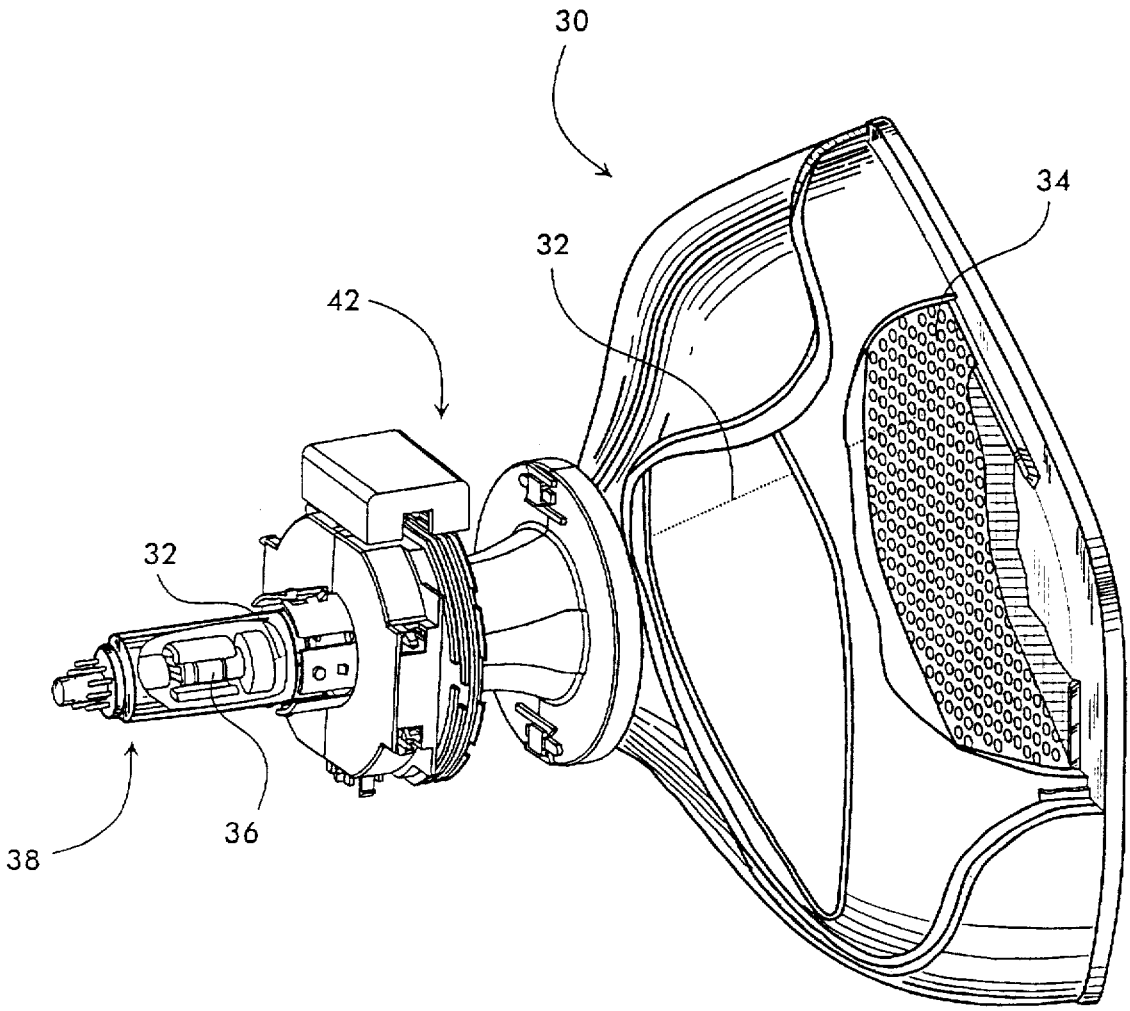

In this particular embodiment, the improved convergence coil assembly and yoke liner is used with a monochrome (one beam) projection-type CRT 30 as shown in FIG. 2. As is known, a CRT 30 forms an image by scanning an electron beam 32 across a phosphor screen 34. The electron beam 32 is emitted from an electron gun 36 located at a first cathode end 38 of the CRT 30 in and then scanned across the screen 34 by a deflection yoke assembly 42. The deflection yoke assembly 42 includes the improved convergence core assembly and the yoke liner according to the principles of the present invention.

Figure 3A:
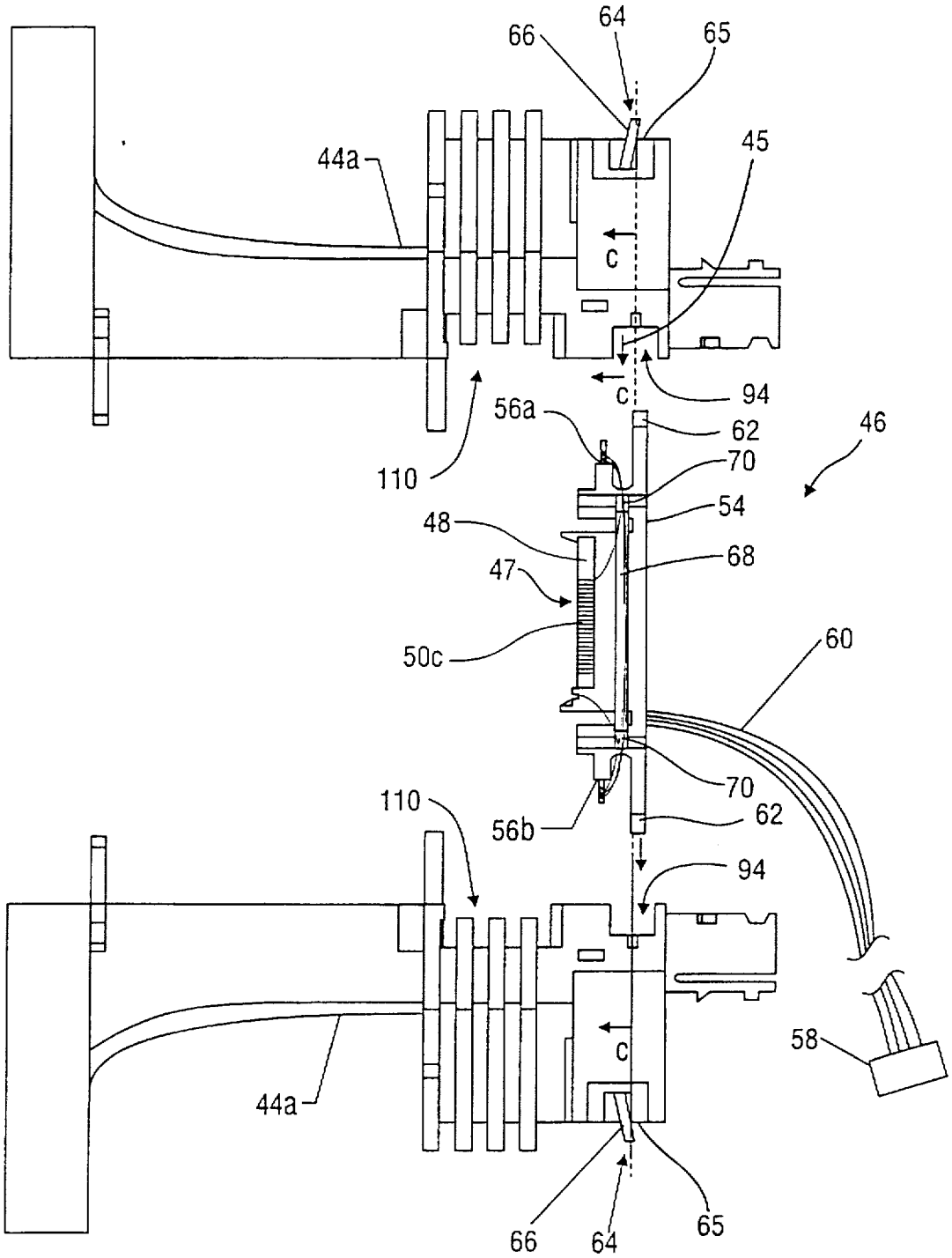
Figure 3B:
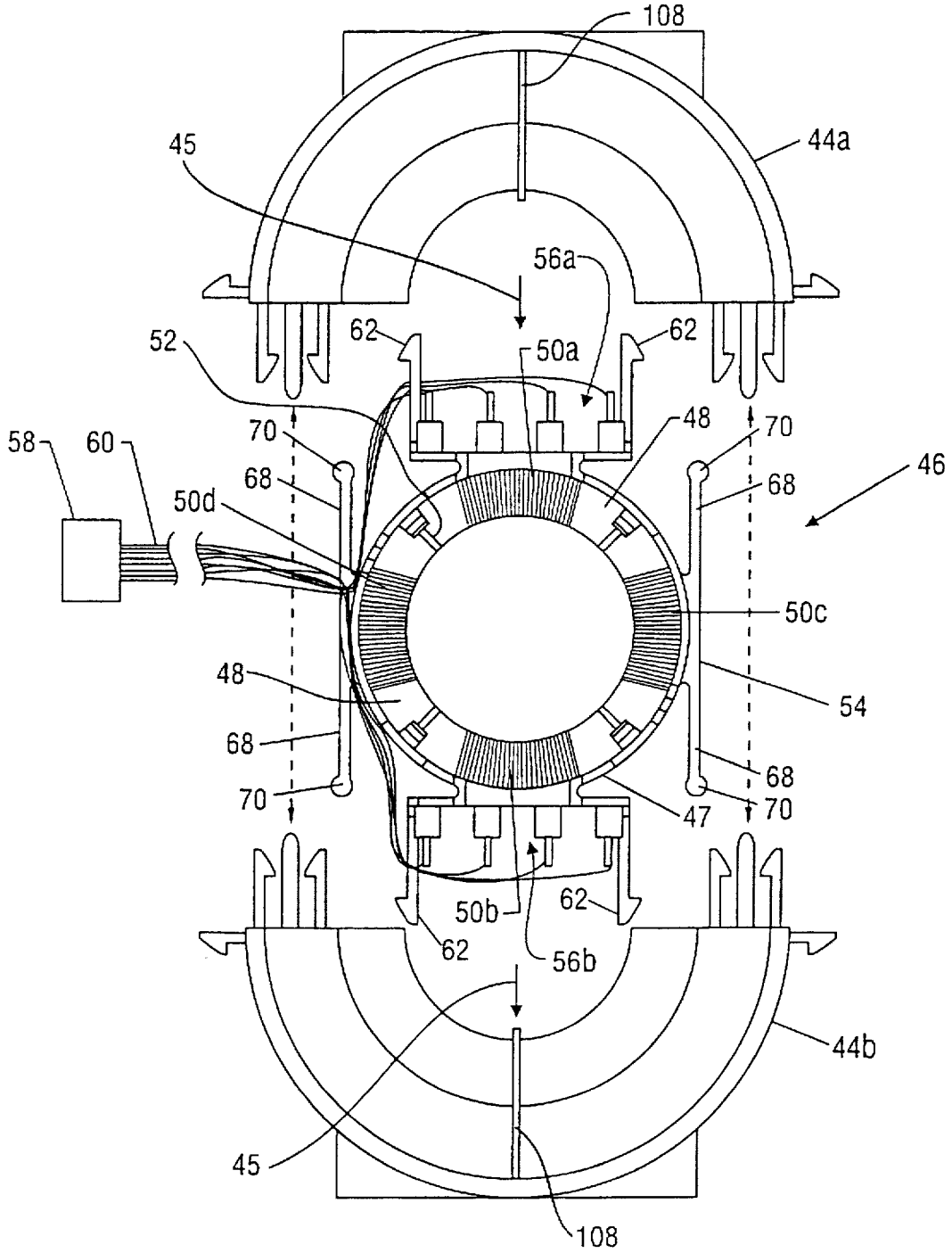

FIG. 3*a* shows a side view of yoke liner halves 44*a* and 44*b* and the improved convergence core assembly 46 according to the principles of the present invention, and FIG. 3*b* shows a front view of the yoke liner halves 44*a* and 44*b* and the convergence core assembly 46 of FIG. 3*a*. The yoke liner halves 44*a* and 44*b* and the convergence core assembly 46 go together as shown by arrow 45. In this particular embodiment, the convergence core assembly 46 includes a convergence core 47 having a core 48, which is typically made of ferrite, and a set of horizontal and vertical torroidal windings 50*a–d* wrapped around the core 48. The core typically has at least one positioning groove or notch 52. A core carriage 54, which can be made from GE "Noryl" 10% glass filled material, has electric terminals 56*a* and 56*b*. The torroidal windings 50*a–d* are connected to the electrical terminals 56*a–b*, and an external electrical connector 58 is connected to the electric terminals 56*a–b* by wires 60. The torroidal windings 50*a–d* are wired such that magnetically opposing fields are created to converge the electron beam.

Figure 3C:
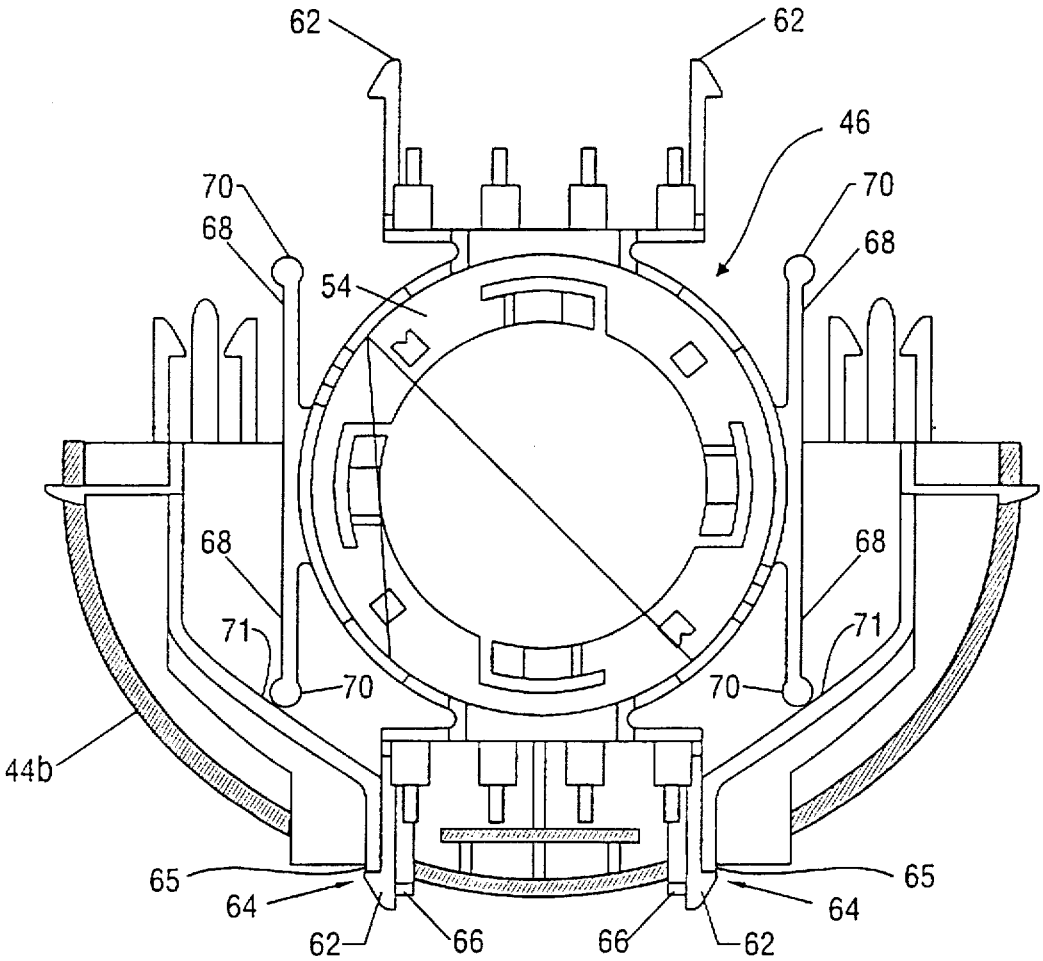
Figure 3D:
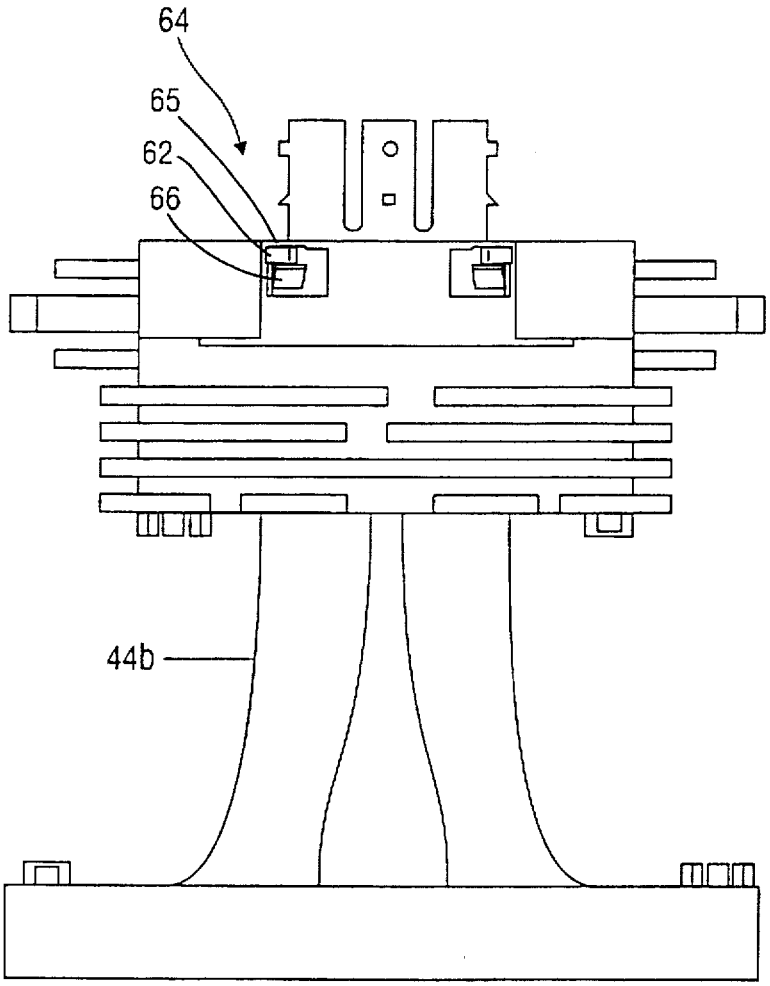

FIG. 3*c* shows a cross-sectional cathode side view of the yoke liner half 44*b* along line c—c with the convergence core carriage 54 in place within the yoke liner half 44*b*. FIG. 3*d* shows a bottom view of the yoke liner 44*b* with the convergence core assembly 46 in place. The core carriage 54 includes a plurality of means for consistently positioning the convergence core assembly 46 (FIG. 3B) in relation to the yoke liner 44. The means for consistently positioning the core carriage 54 within the yoke liner 44*b* includes retaining arms 62 which hold the convergence core assembly 46 in relation to the yoke liner 44*b*. The retaining arms 62 engage retaining means 64 to hold the convergence core assembly 46 to the yoke liner 44. As is particularly useful for assembly, the retaining means 64 has insertion guides 66 which guide the retaining arms 62 into engaging retaining ledge 65 and tend to maintain the convergence core assembly 46 in fixed relation to the yoke liner 44*b*.

Figure 3E:
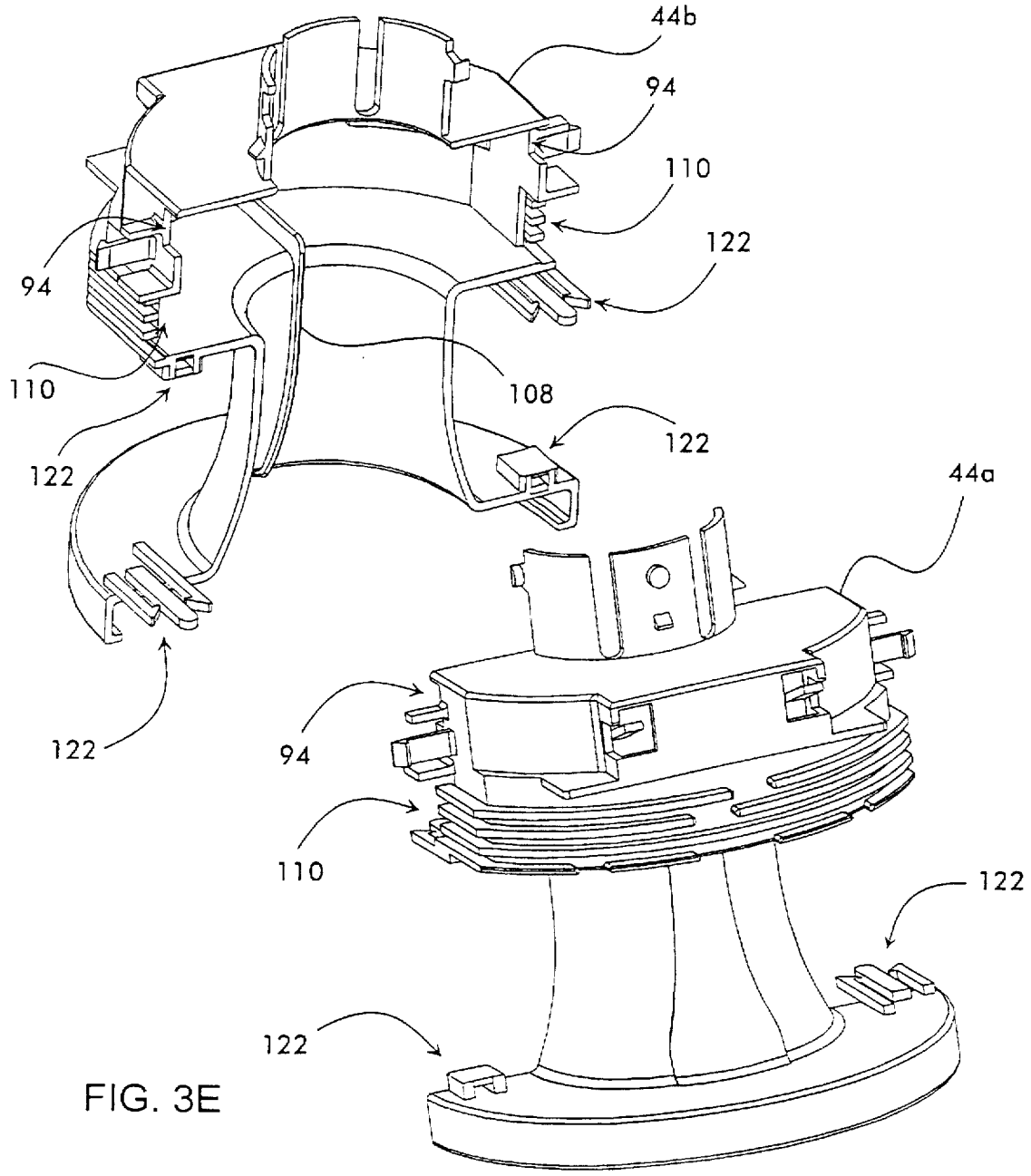

The core carriage 54 includes centering or suspension arms 68 which have radiused suspension tips 70 that engage radiused suspension surfaces 71 of an inside wall of the yoke liner 44*b*. In this particular embodiment, the suspension tips 70 are shown as a radiused tip, but other arrangements, such as an angled tip or spring-loaded suspension arms, are possible. Similarly, the suspension surfaces can be radiused, angled or even flat if spring-loaded suspension arms are used. The suspension arms 68 apply opposing forces (once the upper yoke liner halve 44*a* is in place) to the inner wall of the yoke liner 44 that centers and stabilizes the position of the convergence core assembly 46 within the yoke liner 44. FIG. 3*e* shows perspective views of the yoke liner halves 44*a* and 44*b* according to the particular embodiment.

Figure 4A:
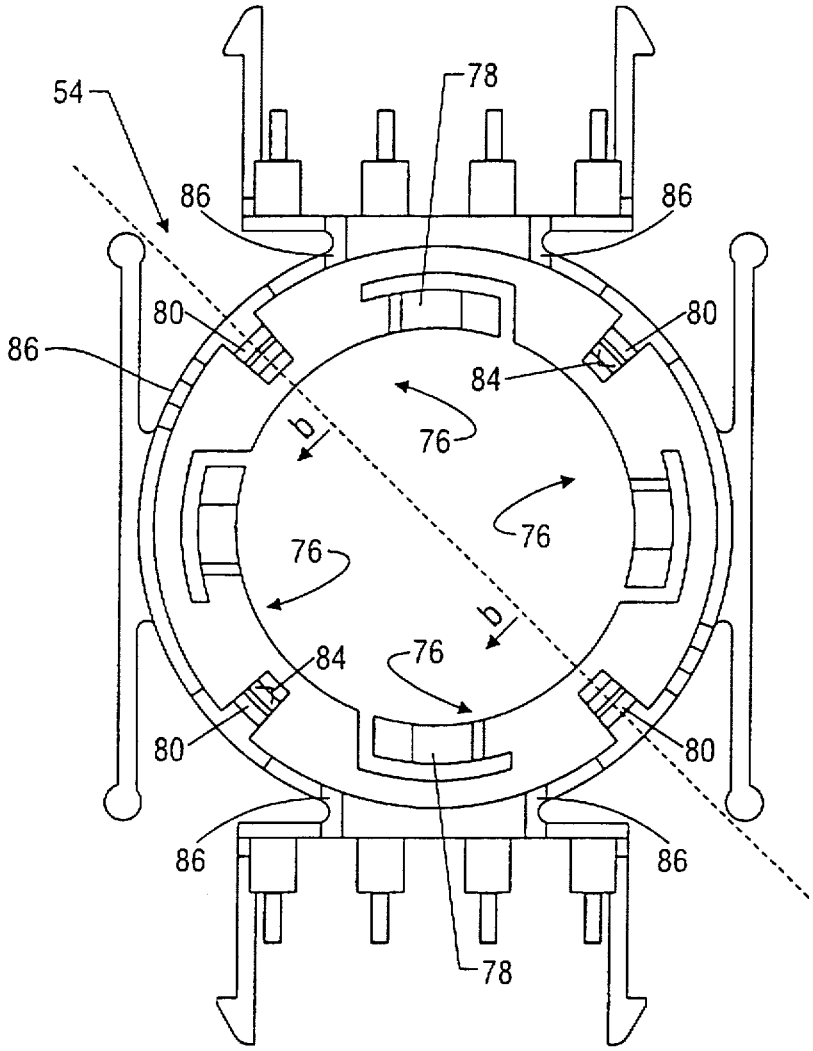
Figure 4B:
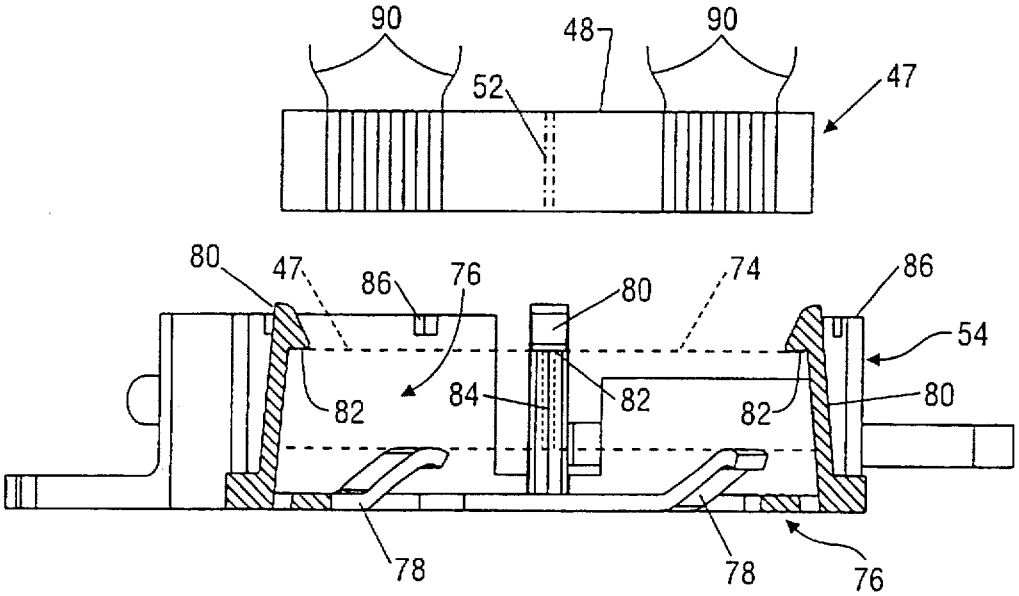

FIG. 4*a* shows a top view of a core carriage 54 without the convergence core 47 therein, and FIG. 4*b* shows a cross-sectional view of the core carriage 54 along line b—b with a convergence core 47 positioned for insertion into the core carriage 54. Dotted lines 74 represent the position of the convergence core electromagnetic coil assembly 47 within the carriage 54. The carriage 54 includes means 76 for positioning the convergence core 47. In this particular embodiment, the means for positioning includes leaf springs 78 and positioning tabs 80. The leaf springs 78 and positioning tabs 80 absorb the size tolerances of the ferrite core 48 and fix the position of the convergence core 47 with respect to the z-axis. The leaf springs 78 tend to force the convergence core 47 against stops 82 of the positioning tabs 80 to properly locate the convergence core 47 in the z-axis.

The position tabs 80 can be angled (at about 5 degrees in this particular embodiment) and flexible to handle ferrite cores 48 of different sizes, thereby allowing larger cores 48 to fit. The positioning tabs 80 exert opposing forces on the convergence core 47 to center the convergence core in the x-y plane. At least one of the positioning tabs 80 has an indexing protrusion 84 to engage the at least one positioning groove 52 of the core 48. The indexing protrusion 84 enables simple and accurate rotational alignment of the convergence core 47. Thus, the means 76 for positioning consistently provides proper alignment and retention of the convergence core 47 in the core carriage 54, and the means for consistently positioning the core carriage 54 in the yoke liner 44 provides proper alignment and retention of the convergence core assembly 46 in the yoke liner 44. The core carriage 54 also preferably includes wire guides or notches 86 for routing leads 90 (FIGS. 4*b* and 4*c*) of the convergence core 47.

Figure 4C:
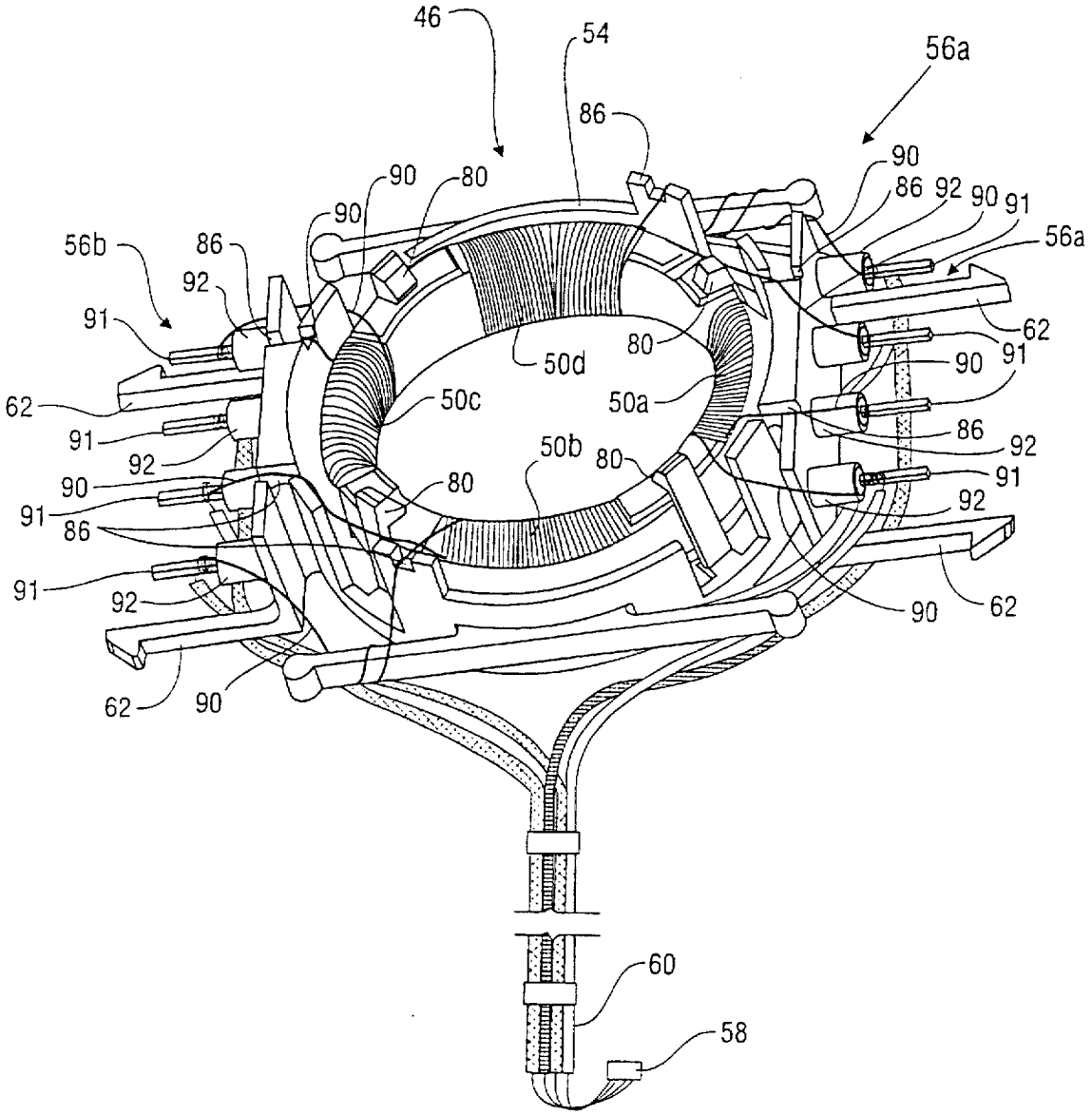

To assemble the convergence core assembly 46, the convergence core 47 is assembled by properly winding the horizontal and vertical windings 50*a–d* onto the core 48, leaving leads 90 from the windings 50*a–d*. The convergence core 47 is then placed into the core carriage 54, and using the wire guides 86, the leads 90 are connected to the terminal lugs 56*a* and 56*b* as shown in FIG. 4*c*. The connector 58 is then connected to the terminals 56*a* and 56*b* through the connection wires 60. As such, the convergence core assembly 46 is assembled. The following steps describe in more detail a method of assembling a deflection yoke assembly according to the principle of the present invention. The steps include:

Wire is wound in a torroidal fashion around the ferrite convergence core to produce the desired electrical/magnetic field performance.

Tin plated square wire is cut to length and press fitted into the 8 bosses 92 of the core carriage 54 to serve as low cost terminal lugs 56*a* and 56*b* for the soldering of the wire leads 90 from the torroidal wrapped, ferrite convergence core 47 (See FIG. 4*c*).

Insert the wire wound ferrite trailer core by placing the core carriage 54 on a flat surface with the 4 positioning tabs 80 up (See FIG. 4*b*). Align the 2 "V" notches 52 with the corresponding "V" protrusions 84 (See FIG. 4*b*) found on the legs of 2 of the 4 positioning tabs 80. With modest pressure, push the convergence core 47 into the core carriage 54 until the positioning tabs 80 engage on the top surface of the ferrite core, thereby capturing, containing and positioning the torroidal wrapped ferrite core 47 securely into the core carriage.

Wire leads 90 are then dressed and terminated to the square wire lugs 91 on the core carriage 54, which are then soldered along with the wires 60 from a connector assembly 58 which completes the unit as a subassembly of the deflection yoke assembly.

The entire deflection yoke assembly is composed of the following parts:

2 plastic yoke liner halves 44*a* and 44*b*

2 horizontal saddle shaped coil halves 2 vertical saddle shaped coil halves 2 vertical ferrite core halves with 2 metal clips 1 convergence core assembly 1 terminal board assembly 2 plastic beam centering rings with one wave washer 1 neck clamp with screw 1 yoke leads and connector assembly As described above, the convergence core assembly 46 is a separate subassembly harness for a ferrite convergence core 47, sometimes called a trailer core. The assembly 46 is used to captivate, position and hold a torroidal wrapped ferrite convergence core 47 and provide for wire lead dressing and termination. Thus, the convergence core assembly 46 is taken as a single unit which facilitates assembling the deflection yoke assembly. Assembling the entire deflection yoke assembly 42 (FIG. 2) requires the following additional steps:

The completed convergence core assembly 46 is inserted into a plastic deflection yoke liner half 44*a* through 2 spring loaded slots or retaining means 64 that will engage the retaining arms 62 on the core carriage 54 that lock the convergence core assembly 46 into the yoke liner half 44*b* (See FIG. 4*d*), fixing the Z axis location of the convergence core assembly 46 with respect to the deflection yoke assembly 42 (FIG. 2) while still allowing some X-Y plane directional movement. The suspension arms 68 of the core carriage 54 engage radial surfaces 71 of the yoke liner 44*b* allowing the convergence core assembly 46 to self center in the X-Y plane with respect to the yoke liner 44*b*.

Figure 4D:
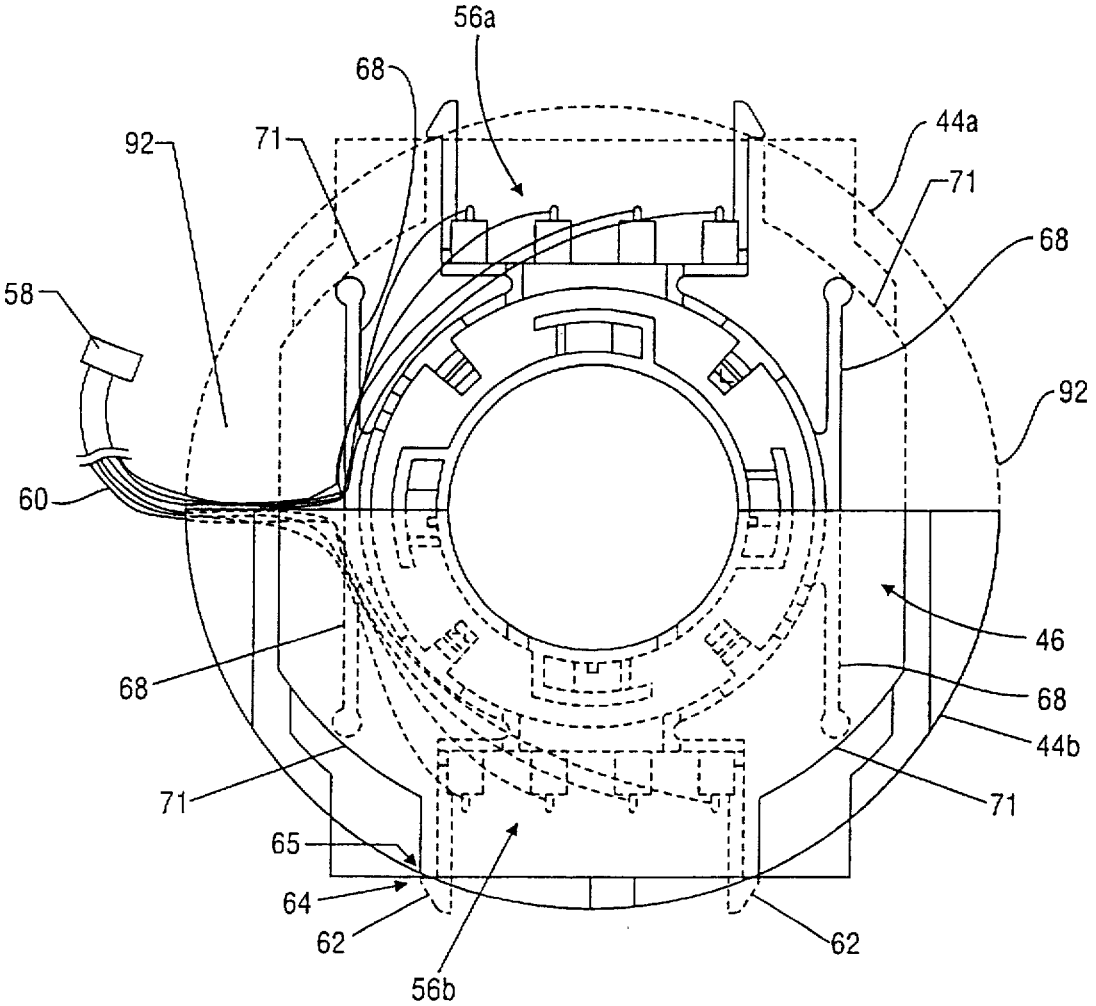
Figure 4E:
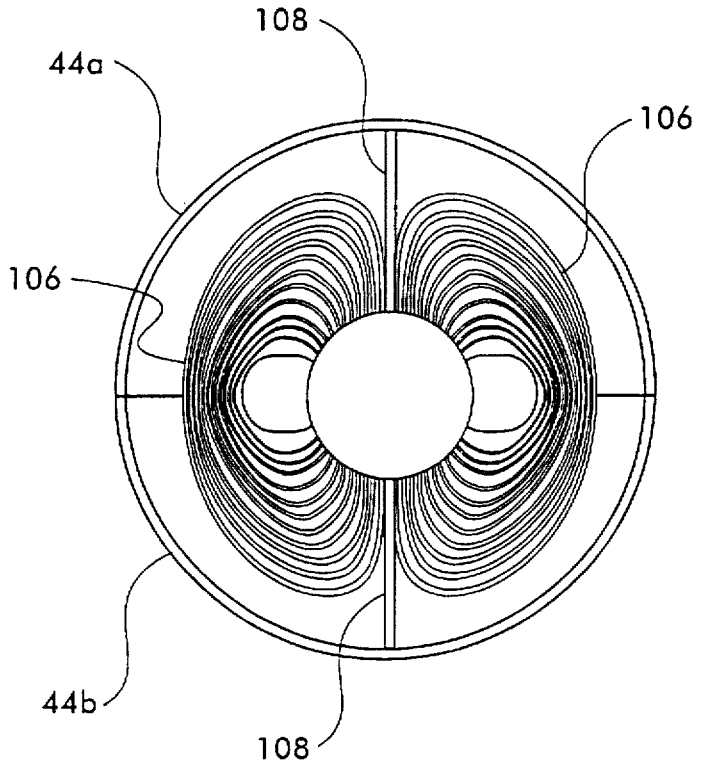

Still working with one half of the deflection yoke liner 44*b* and the assembly 46 held in place on that half of the yoke liner 44*b*, the horizontal saddle shaped coils 106 (FIG. 4*e*) are then inserted to mate with the inner surface of the yoke liner 44*b* butting up against a 0.040 thick center rib 108 that runs the length of the inner surface contour of the yoke liner half 44*b* in the Z axis direction as shown in FIG. 4*e*. The leads from the horizontal coils are pulled out of the way and around the back side of the yoke liner half 44*b* through notched openings 110 (FIGS. 3*a* and 3*e*). While holding the horizontal coils 106 in place with one hand, the other hand is free to snap the remaining yoke liner half 44*a* together with the yoke liner half 44*b*. The two remaining retaining arms 62 of the convergence core assembly 46 should protrude through the corresponding slots or carriage retaining means 64 on the other liner half 44*a* to make a very tight and solid fit between the two halves 44*a* and 44*b* (FIG. 4*d*).

In this particular embodiment, the yoke liner halves 44*a* and 44*b* (FIG. 3*e*) are identical, and the yoke liner halves 44*a* and 44*b* are connected together using a clasp mechanism 122, thereby forming a complete yoke liner 44. The connector 58 and wires 60 pass through an outlet 94 in the yoke liner 44. At this point, the retaining arms 62 engage the retaining means 64 of yoke liner 44 to align and maintain the position of the convergence core assembly 46 within the yoke liner 44. The suspension arms 68 engage the suspension surfaces 71 of the yoke liner 44 to provide further stability and positioning support. After the yoke liner 44 is assembled with the convergence core assembly 46, the deflection yoke assembly 42 (FIG. 2) is completed and installed by performing the following steps.

Figure 5A:
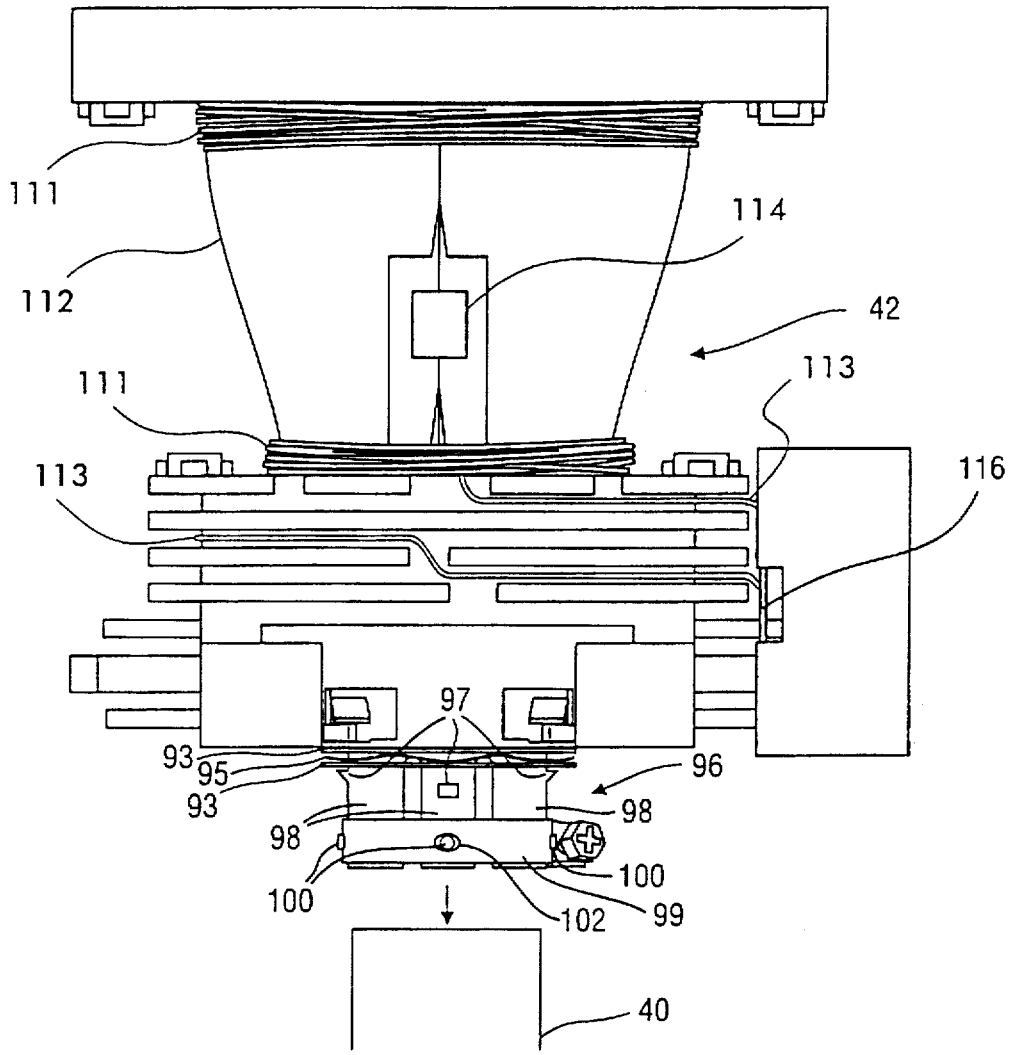
Figure 5B:
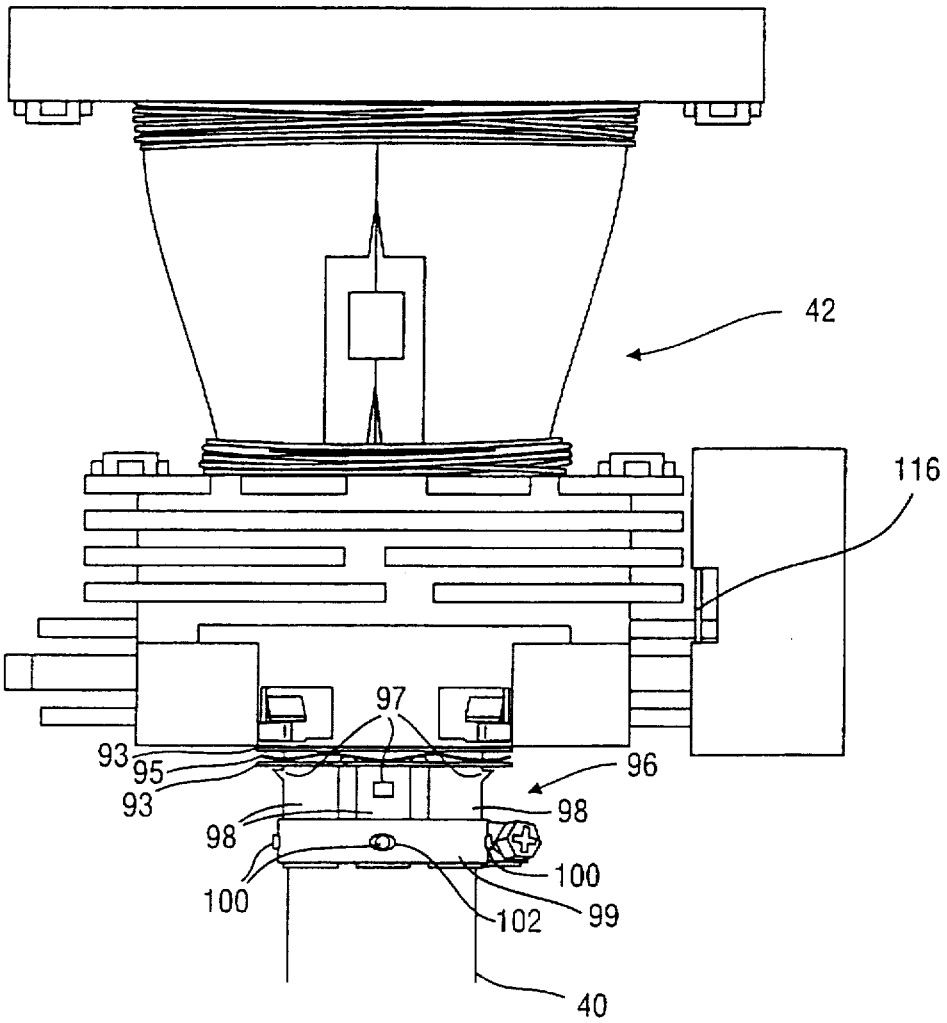

As shown in FIGS. 5*a* and 5*b*, the vertical saddle shaped coils 111 are then placed on the outer contoured surface of the yoke liner at 90° to the horizontal coils 106 (FIG. 4*e*). The vertical coils 111 will butt edges together (in an ideal fit) while remaining flush against the outer yoke liner surface.

Both halves of a vertical ferrite core 112 are then placed around the vertical coils, mated at their butt edges (or crack line) and are held together with metal, spring tempered, snap clips 114. Alternatively, instead of or in addition to saddle-shaped vertical coils, the ferrite core can be torroidally wrapped with wire as the design demands.

The yoke terminal board 116 is then snapped onto the yoke liner 44.

Wire leads 113 from the horizontal and vertical coils 106, 111 are then routed, dressed and soldered to the terminal lugs on the yoke terminal board 116 along with the leads of the yoke connector assembly, which ultimately plugs into the main television chassis board.

As shown in FIGS. 5*a* and 5*b*, two plastic beam centering magnets 93 are mounted by sliding them over the fingers on the neck of the yoke liner with a wave washer 95 separating them to add spring tension. The centering magnets 93 are held to the back surface of the yoke liner under a "stop tab" 97 on the neck fingers 98 of the yoke liner 44.

Lastly a neck clamp 99 with screw is slipped over the neck fingers 98 of the yoke liner 44, oriented by bosses 100 on the fingers 98 engaging in recesses 102 in the neck clamp 99.

Thus, the convergence core assembly and yoke liner according to the principles of the present invention makes the assembly and installation of the deflection yoke assembly much quicker and efficient. Additionally, the convergence core assembly 46 and yoke liner 44 provide improved positional stability and reduce manufacturing cost and time for the deflection yoke assembly. Those skilled in the art will readily recognize that these and various other modifications and changes may be made to the present invention without strictly following the exemplary application illustrated and described herein and without departing from the true spirit and scope of the present invention, which is set forth in the following claims.

I claim:

1. An improved convergence core assembly to improve beam performance in a deflection yoke assembly for a cathode ray tube comprising:

a convergence core having a core and a set of horizontal and vertical toroidal windings wound around the core;

a core carriage for holding the convergence core, the core carriage having means for positioning the convergence core to properly locate the convergence core on the core carriage; and wherein the means for positioning includes leaf springs and positioning tabs, the leaf springs tending to force the convergence core against stops on the positioning tabs.

2. The assembly of claim 1 wherein the core includes a positioning groove and wherein at least one of the positioning tabs has an indexing protrusion to engage the positioning groove on the core for rotational alignment of the core.

3. The convergence core assembly of claim 1 wherein the core carriage further includes means for consistently positioning the convergence core assembly in relation to the deflection yoke assembly.

4. The convergence core assembly of claim 3 wherein the means for consistently positioning the convergence core assembly includes retaining arms which hold the convergence core assembly in a substantially predetermined relation to the deflection yoke assembly.

5. The convergence core assembly of claim 3 wherein the means for consistently positioning the convergence core assembly within the deflection yoke assembly includes suspension arms which engage a wall of the yoke liner of the deflection yoke assembly.

6. The convergence core assembly of claim 1 further including an external electrical connector connected to the electric terminals.

7. An improved convergence core assembly to improve beam performance in a deflection yoke assembly for a cathode ray tube comprising:

a convergence core having a core and a set of horizontal and vertical toroidal windings wound around the core, the core having a positioning groove;

a core carriage with electric terminals and means for positioning the convergence core, the means for positioning including leaf springs and positioning tabs, the leaf springs tending to force the convergence core against stops on the positioning tabs to properly locate the convergence core in the z-axis, one of the positioning tabs having an indexing protrusion to engage the positioning groove for rotational alignment of the convergence core, leads from the set of horizontal and vertical toroidal windings being connected to the electric terminals, the core carriage further including means for consistently positioning the convergence core assembly in relation to the deflection yoke assembly; and an external electrical connector connected to the electric terminals.

8. The convergence core assembly of claim 7 wherein the means for consistently positioning the convergence core assembly includes retaining arms which hold the convergence core assembly in relation to the deflection yoke assembly.

9. The convergence core assembly of claim 7 wherein the means for consistently positioning the convergence core assembly includes suspension arms which engage an inside wall of the deflection yoke assembly.

10. An in-process deflection yoke assembly for a cathode ray tube comprising:

(1) a yoke liner with carriage retaining means and carriage insertion guides and carriage centering surfaces on a wall of the yoke liner; and (2) a convergence core assembly comprising:

(a) a convergence core having a core and a set of windings wound around the core, the core having a positioning groove; and (b) a core carriage with means for positioning the convergence core, the means for positioning including leaf springs and positioning tabs, the leaf springs tending to force the convergence core against stops on the positioning tabs to properly locate the convergence core in the z-axis, the positioning tabs centering the convergence core in the x-y plane, one of the positioning tabs having an indexing protrusion to engage the positioning groove for rotational alignment of the convergence core, the core carriage further including retaining arms which engage the carriage retaining means of the yoke liner to hold the convergence core assembly in relation to the yoke liner, the carriage insertion guides guiding the retaining arms to the carriage retaining means and tending to maintain the convergence core assembly in fixed relation to the yoke liner.

11. A method of assembling an improved convergence coil assembly for a cathode ray tube comprising the steps of:

assembling a convergence core assembly comprising a convergence core having a core and a set of windings wound around the core and a core carriage with means for positioning the convergence core, the core carriage further including retaining arms; and inserting the convergence core assembly into a bottom yoke liner half such that the retaining arms of the convergence core assembly engage and secure the convergence core assembly to carriage retaining means of the bottom yoke liner half to hold the convergence core assembly in relation to a deflection yoke assembly.

12. The method of claim 11 wherein said step of assembling includes providing the convergence core assembly with electric terminals, the means for positioning includes leaf springs and positioning tabs, the leaf springs tend to force the convergence core against stops of the positioning tabs to properly locate the convergence core.

13. The method of claim 12 wherein said step of assembling includes engaging an indexing protrusion of at least one positioning tab with at one least positioning groove on the core for rotational alignment of the convergence core.

14. The method of claim 12 wherein said step of assembling further includes the step connecting leads from the set of windings to the electric terminals on the core carriage.

15. The method of claim 11 further including the step of connecting a top yoke liner half to the bottom yoke liner half to form the yoke liner.

16. The method of claim 15 wherein the step of inserting includes the step of using carriage insertion guides of the yoke liner to guide the retaining arms into the carriage retaining means and to maintain the convergence core assembly in fixed relation to the yoke liner.

17. The method of claim 15 wherein the step of inserting includes the providing the core carriage with suspension arms which engage centering surfaces of at least one wall.

18. The method of claim 12 wherein said step of assembling further includes the step of connecting an external electrical connector to the electric terminals.

19. A method of assembling an improved deflection yoke assembly for a cathode ray tube comprising the steps of:

providing a first yoke liner half with carriage retaining means, carriage insertion guides and carriage centering surfaces;

assembling a convergence core assembly comprising a convergence core and a core carriage positioning the convergence core in the carriage, the core carriage further including first and second sets of retaining arms, the first set of retaining arms engaging the carriage retaining means of the first yoke liner half to hold the convergence core assembly in relation to the first yoke liner half;

inserting the convergence core assembly into the first yoke liner half such that the retaining arms of the convergence coil assembly engage the carriage retaining means of the first yoke liner half;

inserting a first set of deflection coils into the first yoke liner half;

snapping a second yoke liner half to the first yoke liner half such that the second set of retaining arms engage carriage retaining means of the second yoke liner half; and placing a second set of deflection coils on an outer surface of the first and second yoke liner halves.

* * * * *